US005190260A

United States Patent [19]

Daubenspeck

[11] Patent Number: 5,190,260

[45] Date of Patent: Mar. 2, 1993

[54] WATER HEATER TANK SUPPORT

[76] Inventor: Richard P. Daubenspeck, 23275 Caminito Marcial, Laguna Hills, Calif. 92653

[21] Appl. No.: 758,335

[22] Filed: Aug. 28, 1991

Related U.S. Application Data

[63] Continuation of Ser. No. 581,039, Sep. 12, 1990, abandoned.

[51] Int. Cl.[5] ..... A47K 17/00

[52] U.S. Cl. ..... 248/313; 248/74.3; 248/146

[58] Field of Search ..... 248/313, 309.1, 154, 248/146, 74.3, 231, 505, 499, 311.2; 126/363; 220/480, 481, 565

[56] References Cited

U.S. PATENT DOCUMENTS

| | | | |
|---|---|---|---|
| 991,192 | 5/1911 | Battenfeld . | |
| 1,256,550 | 2/1918 | Goold et al. . | |
| 1,427,375 | 8/1922 | Gove | 248/313 |
| 1,625,716 | 4/1927 | Edwards | 248/231 X |
| 2,226,713 | 12/1940 | Folmsbee . | |
| 2,463,880 | 3/1949 | Jones | 220/565 X |
| 2,679,993 | 6/1954 | Christophersen . | |
| 2,707,611 | 5/1955 | Fricke . | |
| 2,870,982 | 1/1959 | Greene et al. | 248/146 |
| 2,915,799 | 12/1959 | Andreasen . | |
| 3,643,813 | 2/1972 | Noonan . | |
| 3,765,635 | 10/1973 | Burrell et al. . | |
| 3,771,751 | 11/1973 | Derivaz . | |
| 3,966,154 | 6/1976 | Perrault et al. . | |
| 4,379,541 | 4/1983 | Harkness . | |
| 4,505,448 | 3/1985 | Massie . | |
| 4,627,133 | 12/1986 | Bartlow | 248/499 |
| 4,754,941 | 7/1988 | Weiss . | |
| 4,955,573 | 9/1990 | Horvath | 248/154 X |
| 5,020,760 | 6/1991 | Mayr | 248/313 |

FOREIGN PATENT DOCUMENTS

| | | | |
|---|---|---|---|
| 2745094 | 4/1979 | Fed. Rep. of Germany | 248/231 |
| 652985 | 3/1929 | France | 248/146 |
| 954943 | 6/1956 | Netherlands | 248/146 |
| 1096826 | 1/1961 | Netherlands | 248/154 |
| 834652 | 5/1960 | United Kingdom | 248/146 |

*Primary Examiner*—Karen J. Chotkowski

*Attorney, Agent, or Firm*—Knobbe, Martens, Olson & Bear

[57] ABSTRACT

A water heater tank support system for securing a water heater tank to an adjacent wall is disclosed. The system comprises first and second mounting brackets connected to the wall and disposed on opposite sides of the tank. Each of the mounting brackets includes a first portion disposed proximate a peripheral portion of the tank. A strap is provided which extends between the two brackets and about the tank. The strap comprises a first end portion connected to a first bracket, and extends about the bracket, a first portion of the water tank, and along the surface of the second bracket. The strap is secured to the second bracket and drawn about a second portion of the water tank to the first bracket where it is secured to the first end portion and to the first bracket.

15 Claims, 2 Drawing Sheets

WATER HEATER TANK SUPPORT

This application is a continuation of application Ser. No. 07/581,039 filed Sep. 12, 1990 and now abandoned.

BACKGROUND OF THE INVENTION

The present invention relates to adjustable support systems and, more particularly to apparatus for supporting a water heater tank against and to an adjacent wall.

Water heaters of various sizes are commonly found in residential and commercial buildings throughout the country. Because such devices are typically mass produced for distribution throughout the country they are not typically constructed to include bracing devices to prevent movement of the water heater tank in the event of an earthquake or other violent motions. Such movement of the water heater tank in response to seismic activity can result in the tank breaking way from its installed position, causing damage to the tank as well as potential fire or water damage.

Although prior water heater tank bracing devices have been proposed such devices are either formed as an integral portion of the manufactured device, designed for installation prior to installation of the water heater tank, or require removal of the water tank in order to install and/or mount the bracing device. Such contemporary devices are therefore inadequate to satisfy the practical needs of most users who are unable or unwilling to remove the water heater tank from its existing location in order to install the support device and do not buy water heater tanks with such premounted devices. Thus, there exists a need for a device that can serve to secure the water heater tank to an existing wall without the need to remove water heater from its existing location. There exists a further need for such a bracing device which can accommodate different size water heaters and be easily installed by individuals having little or no mechanical or construction experience. The present invention is directed to a water heater tank support system that satisfies these and other needs not met by existing apparatus, as described in more detail below.

SUMMARY OF THE INVENTION

A water heater tank support system for securing a water heater tank to an adjacent wall is disclosed. The system comprises first and second mounting brackets connected to the wall and disposed on opposite sides of the tank. Each of the mounting brackets includes a first portion disposed proximate a peripheral portion of the tank. A strap is provided which extends between the two brackets and about the tank. The strap comprises a first end portion connected to a first bracket, and extending over the bracket, and behind the water tank, and over the top of the second bracket. The strap is secured to the second bracket and drawn about a front portion of the water tank to the first bracket where it is secured to the first end portion and to the first bracket.

The invention further comprises means for adjustable securing the strap to the first and second brackets to regulate tension of the strap about the tank. Spacing members may be provided intermediate the brackets and the wall to adjustable position the brackets with respect to the tank. Mounting members may be provided intermediate the bracket and the wall to facilitate mounting the brackets to the wall.

DETAILED DESCRIPTION OF THE PRESENTLY PREFERRED EMBODIMENT

The detailed description set forth below in connection with the appended drawings is intended merely as a description of the presently preferred embodiment of the invention, and is not intended to represent the only form in which the present invention may be constructed or utilized. The description sets forth the functions and steps for installing the invention, in connection with the illustrated embodiment. It is to be understood, however, that the same, or equivalent functions or installation steps may be accomplished by different embodiments that are also intended to be encompassed within the spirit and scope of the invention.

Figure 1:
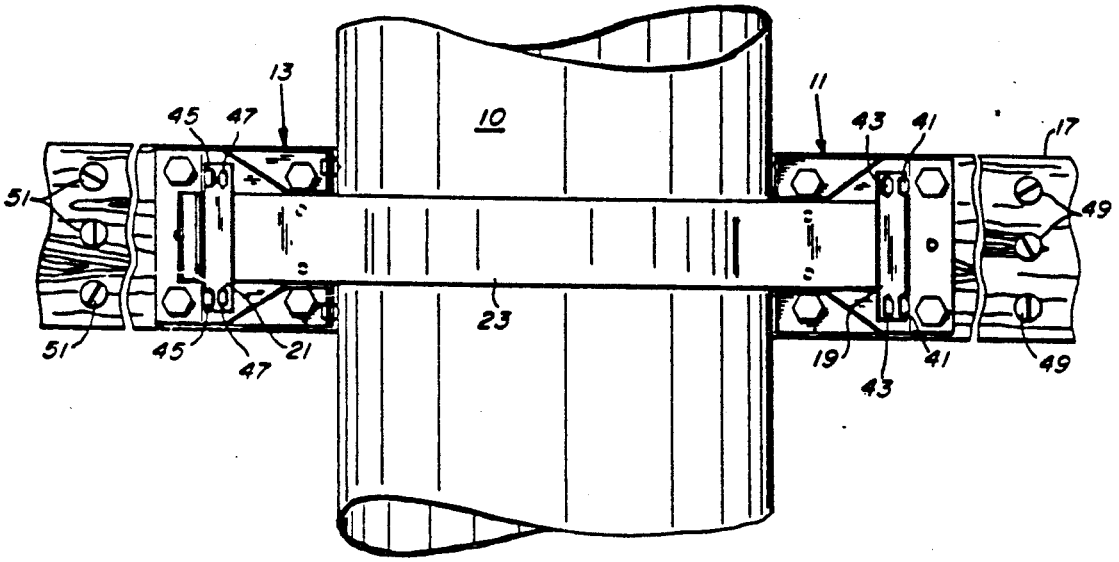
FIG. 1 is a front view of the presently preferred embodiment of the invention as extending about a water heater tank.
Figure 2:
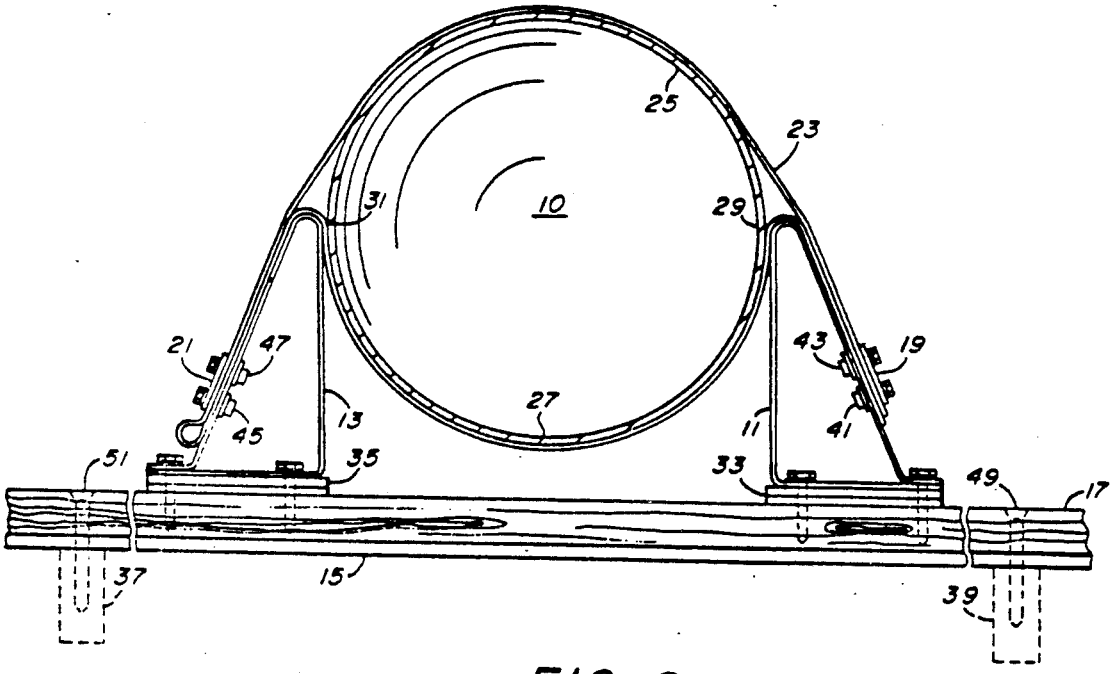
FIG. 2 is a top view of the embodiment set forth at FIG. 1.

Referring to the drawings and, more particularly to FIGS. 1 and 2, illustrating the present invention as used to maintain water heater tank 10 in place against wall 15. Brackets 11 and 13 are shown mounted against beam 17 which, in turn, is mounted to wall 15. In the illustrated embodiment wall 15 is typically formed of material such as plasterboard as is typically found in many residential and commercial environments. However, it is to be understood that the present invention may be utilized to secure a water heater in place against an available wall of any type of construction, e.g., wood, metal, etc.

In the illustrated embodiment the brackets 11 and 13 are secured to beam 17 by means of any convenient fastener such as screws, or other fasteners. Beam 17, which may be made of Grade 1 Douglas Fir or other material, is preferably secured to plasterboard wall 15 by means of fasteners 49 and 51 extending into wall studs 37 and 39. Fasteners 49 and 51 may similarly be any available type of fastener such as screws, nails or the like, which can secure the brackets in place and accommodate the tension utilized to hold the water heater tank 10 in place.

Beam 17 and brackets 11 and 13 may be installed without need to remove water heater 10. As shown at FIGS. 1 and 2 beam 17, and brackets 11 and 13 are secured to the wall outside of the diameter of tank 10. Thus, the installation of the invention may be accomplished by individuals having little or no mechanical or construction skills.

Brackets 11 and 13 are preferably formed to have portions 29 and 31 extending proximate to the periphery of tank 10 at its widest point. It is to be understood, however, that various alternative constructions of the brackets 11 and 13 may be utilized such that the location of the brackets with respect to the periphery of tank 10 may be varied in accordance with the particular construction used. To facilitate the location of portions 29 and 31 with respect to tank 10 spacers 33 and 35 may be used to move portions 29 and 31 to the desired location.

Strap 23 is secured to brackets 11 and 13, and extends about tank 10 to secure tank 10 in place with respect to the brackets and the wall. A first end portion of strap 23 is initially secured to bracket 11 by means of fasteners 41 and 43. The strap 23 is then extended about portion 29 of bracket 11 and about portion 27 of tank 10. Upon reaching bracket 13 the strap 13 is drawn about portion 31 and secured to bracket 13 by fasteners 45 and 47. In the presently preferred embodiment strap 23 may be a single piece which is curled over itself along the surface of bracket 13, extended about portion 25 of tank 10, and has a second end secured to bracket 11. It is to be understood, however, that strap 23 may alternatively be in separate sections, having a first section extending about portion 27 of the tank 10, and a second section extending about portion 25 of tank 10.

Plates 19 and 21 are used to exert compressive pressure against strap 23 to secure it in place as desired. As will be obvious to those skilled in the art the strap 23 may be drawn beneath plates 19 and 21, and those plates tightened to the brackets to obtain the desired degree of tension of strap 23 about tank 10. Moreover, strap 23 may have a variety of apertures therein, with the fasteners 41, 43, 45 and 47 disposed to fit through those apertures and through apertures in the brackets 11 and 13 to also regulate the desired tension on strap 23.

Figure 3:
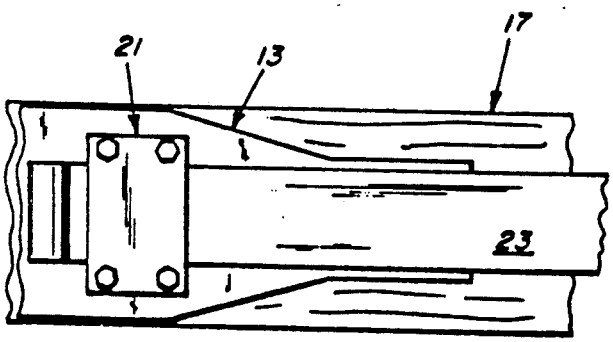
FIG. 3 is a sectional view of a portion of the embodiment set forth at FIGS. 1 and 2.

FIG. 3 illustrates a section of the construction set forth at FIGS. 1 and 2 showing in further detail the manner in which strap 23 is secured to the surface of bracket 13.

Figure 4A:
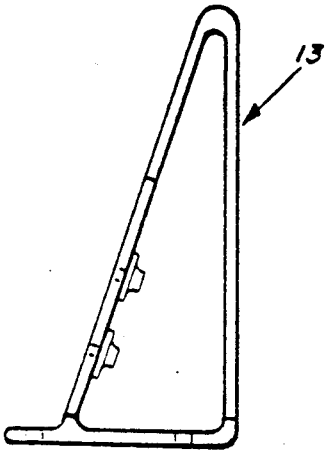
FIGS. 4*a* and 4*b* are views of an exemplary mounting bracket used in conjunction with the present invention.
Figure 4B:
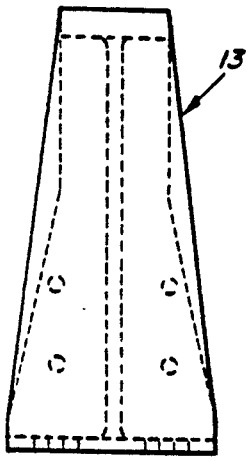
Figure 5A:
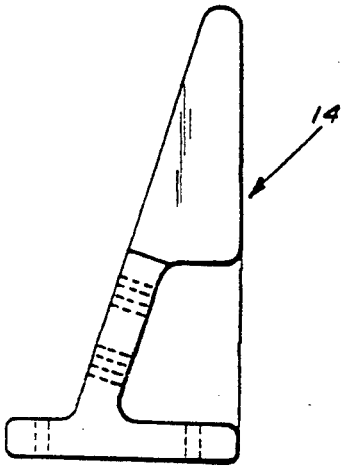
FIGS. 5*a* and 5*b* are view of an alternative mounting bracket for use in conjunction with the present invention.
Figure 5B:
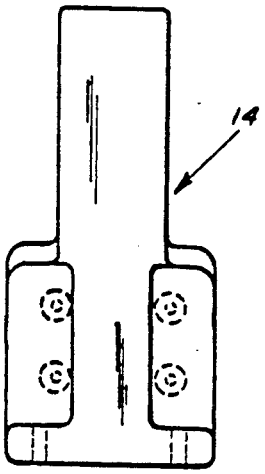

FIGS. 4*a* and 4*b* illustrate side and end views of bracket 13. FIGS. 5*a* and 5*b* illustrate alternative constructions of the bracket that may be used in conjunction with the present invention. It is to be understood that various designs of the brackets may be implemented consistent with the type of materials used to form the bracket. In the presently preferred embodiment the bracket may be a steel or aluminum sheet. However, it is anticipated that the brackets may be a casting, extrusion or molded plastic instead.

In the presently preferred embodiment the strap 23 is a corded cloth fabric with wires running lengthwise entwined in the cloth. However, other materials such as aluminum, steel, sheet metal, leather, plastic or nylon with impregnated wires extending lengthwise therethrough may alternatively be used.

A typical installation procedure for utilizing the present invention is as follows. Where the invention is to be used to support the water heater tank against a plasterboard wall. A beam is typically used to support the brackets against the wall. However, a beam may not be required where the wall 19 is constructed of wood, brick or metal, i.e., the brackets may be installed directly to the wall if feasible. Spacers may be used as necessary to extend the brackets from the wall to the desired point adjacent the tank. The strap may be disposed intermediate the brackets and the water tank to determine proper spacing of the brackets along the beams. Thereafter, the brackets are secured to the beam and a first end of the strap secured temporarily to one of the brackets. The strap is then pulled about the back side of the tank and the drawn along the surface of the opposing bracket to about 1.5 inches (3.81 cm.) from the bottom of the bracket. The strap is then wrapped over itself and secured to the bracket by means of a plate. The bracket is then extended about the front side of the water heater and drawn back to the first bracket where it is secured to the bracket. The strap may be cemented or otherwise adhered to the overlapping regions of the strap and/or to the surface of the bracket. The strap is preferably pulled tight about the water tank and torqued to a degree to facilitate engagement with the tank, without causing distortion of the tank.

As described above, the foregoing description represents only the presently preferred embodiment of the invention. Various modifications, additions and substitutions may be made to the invention without departing from the spirit or scope of the invention.

What is claimed is:

1. A water heater tank and lateral support system for securing a water heater tank to an adjacent vertical wall comprising:

an elongated vertically oriented, tank;

a first and second separate mounting brackets connected to the wall and disposed on opposite sides of the tank, each of said brackets having a first end portion disposed proximate a peripheral portion of the tank and spaced from each other a distance about equal to the diameter of the tank, thereby enabling the brackets to be mounted after the tank is in position adjacent a wall; and a strap for securing the water heater tank to said mounting brackets, said strap having a first end portion connected to said first bracket and extending about said first bracket end portion and a portion of the water tank facing said wall, said strap being secured to said second bracket and extending about said second bracket first end portion and a portion of the water tank facing away from said wall, said strap having a second end portion secured to said first bracket.

2. The system as recited in claim 1 further comprising means for adjustably securing said strap to said first bracket to regulate tension of said strap about the tank.

3. The system as recited in claim 1 further comprising means for adjustably securing said strap to said second bracket to regulate tension of said strap about the tank.

4. The system as recited in claim 1 further comprising spacing members disposed intermediate said brackets and the wall to adjustably position said first portions of the brackets with respect to the tank.

5. The system as recited in claim 1 further comprising a mounting member disposed intermediate said brackets and the wall to facilitate mounting the brackets to the wall.

6. The system as recited in claim 1 wherein said first and second mounting brackets are formed of metal.

7. The system as recited in claim 1 wherein the first and second mounting brackets are formed to molded plastic material.

8. The system as recited in claim 1 wherein the strap is a single length of corded cloth with wires running lengthwise therethrough.

9. The system as recited in claim wherein the strap is a single length of a sheet metal.

10. The system as recited in claim 1 wherein the strap is plastic with impregnated wire running lengthwise therethrough.

11. The system as recited in claim 1 wherein the strap is of leather.

12. The system as recited in claim 1 wherein the strap is of nylon with impregnated wire running lengthwise therethrough.

13. The system of claim 1, wherein said brackets are connected to said wall at locations spaced at least a dimension equal to the diameter of said tank.

14. A water heater tank support system for securing a water heater tank to an adjacent wall comprising:

first and second separate mounting brackets connected to the wall and disposed on opposite sides of the tank at locations spaced at least a dimension equal to the diameter of such tank, each of said brackets having a first end portion disposed proximate a peripheral portion of the tank and spaced from each other a distance about equal to the diameter of the tank, thereby enabling the brackets to be mounted after the tank is in position adjacent a wall; and a strap for securing the water heater tank to said mounting brackets, said strap having a first end portion connected to said first bracket and extended about said first bracket end portion and a portion of the water tank facing said wall, said strap being secure to said second bracket and extended about said second bracket first end portion and a portion of the water tank facing away from said wall, said strap having a second end portion secure to said first bracket, said brackets each having a generally triangular configuration with one side of each bracket being attached to said wall, and each of said free end portions of said brackets being an apex of said triangular shape opposite from said one side.

15. A water heater tank support system for securing a water heater tank to an adjacent wall comprising:

first and second separate mounting brackets connected to the wall and disposed on opposite sides of the tank, each of said brackets having a first end portion disposed proximate a peripheral portion of the tank and spaced from each other a distance about equal to the diameter of the tank, thereby enabling the brackets to be mounted after the tank is in position adjacent a wall; and a strap for securing the water heater tank to said mounting brackets, said strap having a first end portion connected to the exterior of said first bracket and extended about and engaging the exterior of said first bracket end portion and a portion of the water tank facing said wall, said strap being secure to the exterior of said second bracket and extendable about and engaging the exterior of said second bracket first end portion and a portion of the water tank facing away from said wall, said strap having a second end portion secure to the exterior of said first bracket.

* * * * *